US009228591B2

(12) United States Patent
Choi et al.

(10) Patent No.: US 9,228,591 B2
(45) Date of Patent: Jan. 5, 2016

(54) AIR CONDITIONER WITH OUTDOOR UNIT

(75) Inventors: Seok Ho Choi, Changwon-si (KR); Dongsoo Moon, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 834 days.

(21) Appl. No.: 13/267,520

(22) Filed: Oct. 6, 2011

(65) Prior Publication Data

US 2012/0108161 A1 May 3, 2012

(30) Foreign Application Priority Data

Oct. 27, 2010 (KR) ..... 10-2010-0105396

(51) Int. Cl.
*F04D 29/16* (2006.01)
*F04D 29/32* (2006.01)

(52) U.S. Cl.
CPC ..... *F04D 29/164* (2013.01); *F04D 29/326* (2013.01)

(58) Field of Classification Search
CPC . F04D 19/002; F04D 25/064; F04D 25/0646; F04D 29/12; F04D 29/08; F04D 29/164; F04D 29/326; F04D 29/664; F04D 29/667; F04D 29/164; F01D 11/08; F01D 5/225; F01D 5/20
USPC ..... 415/119, 121.2, 168.4, 171.1, 173.1, 415/173.6; 416/179, 185, 189, 193 R
See application file for complete search history.

(56) References Cited

U.S. PATENT DOCUMENTS 3,189,982 A * 6/1965 Merz ..... 29/889.3
3,447,741 A * 6/1969 Soulez-Lariviere et al. ..... 415/208.2
3,842,902 A * 10/1974 Poslusny ..... 165/51
5,183,382 A * 2/1993 Carroll ..... 415/173.6
5,437,541 A * 8/1995 Vainrub ..... 416/223 R
5,489,186 A 2/1996 Yapp et al.
6,027,307 A * 2/2000 Cho et al. ..... 415/173.5
6,508,624 B2 * 1/2003 Nadeau et al. ..... 415/173.3
6,688,848 B2 * 2/2004 Ohtsuka ..... 416/189
D511,824 S * 11/2005 Chen et al. ..... D23/370
7,384,241 B2 * 6/2008 Watanabe et al. ..... 416/192
7,484,925 B2 * 2/2009 Carlson et al. ..... 415/79
7,762,769 B2 * 7/2010 Stevens et al. ..... 415/220
7,789,622 B2 * 9/2010 Acre ..... 415/209.3
8,277,180 B2 * 10/2012 Blass et al. ..... 415/220
2004/0146395 A1 * 7/2004 Uselton ..... 415/119
2006/0067820 A1 * 3/2006 Wang et al. ..... 415/220
2010/0086405 A1 * 4/2010 Higo et al. ..... 416/189
2010/0229810 A1 * 9/2010 Blass et al. ..... 123/41.57
2011/0017427 A1 * 1/2011 Kato et al. ..... 165/59

FOREIGN PATENT DOCUMENTS

CN 1441170 A 9/2003
CN 1534201 A 10/2004
CN 201475009 U 5/2010

* cited by examiner

*Primary Examiner* — Nathaniel Wiehe
*Assistant Examiner* — Michael Sehn
(74) *Attorney, Agent, or Firm* — Dentons US LLP

(57) ABSTRACT

An outdoor unit of an air conditioner is disclosed. The outdoor unit includes: a casing, including a portion defining an outlet through which air is discharged from the outdoor unit; an axial flow fan disposed in the casing for blowing air through the outlet, wherein the axial flow fan comprises: a hub; a plurality of main wings extending from the hub; and a rim connecting the main wings to one other and rotating integrally with the main wings; and one or more air entry blockers disposed at a clearance space between the rim and the portion of the casing defining the outlet.

7 Claims, 6 Drawing Sheets

AIR CONDITIONER WITH OUTDOOR UNIT

CROSS-REFERENCE TO RELATED APPLICATION

This application claims priority from Korean Patent Application No. 10-2010-0105396, filed on Oct. 27, 2010 in the Korean Intellectual Property Office, the entire contents of which are incorporated herein by reference for all purposes as if fully set forth herein.

BACKGROUND OF THE INVENTION

1. Field of the Invention

Exemplary embodiments of the present invention relate to an outdoor unit of an air conditioner, and more particularly, to an outdoor unit including an axial flow fan.

2. Description of the Related Art

In general, an air conditioner is an apparatus that provides users with a more pleasant indoor environment by cooling/heating an indoor space using a refrigeration cycle for refrigerant, constituted by a compressor, condenser, expansion unit, and an evaporator, or by filtering indoor air.

Such a typical air conditioner comprises an indoor unit installed indoors to perform heat exchange between refrigerant and indoor air to discharge hot air or cold air into the indoor space, and an outdoor unit connected to the indoor unit through a refrigerant pipe to perform heat exchange between refrigerant and outdoor air.

Here, in order to allow effective phase change of refrigerant in the outdoor unit, an axial flow fan is provided to blow air in the outdoor unit to the outside. A major limitation with blower units employing such axial flow fans is tip leakage loss, which reduces airflow and increases rotating noise.

SUMMARY OF THE INVENTION

Accordingly, the present invention is directed to an outdoor unit of an air conditioner that substantially obviate one or more problems due to limitations and disadvantages of the related art.

An advantage of the present invention is to provide a outdoor unit of an air conditioner that reduces noise.

Another advantage of the present invention is to provide an outdoor unit of an air conditioner that increases airflow blown by an axial flow fan.

Another advantage of the present invention is to provide an outdoor unit of an air conditioner that reduces occurrence of leakage flow at the wing tips of an axial flow fan.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an outdoor unit of an air conditioner may include: a casing, including a portion defining an outlet through which air is discharged from the outdoor unit; an axial flow fan disposed in the casing for blowing air through the outlet, wherein the axial flow fan comprises: a hub; a plurality of main wings extending from the hub; and a rim connecting the main wings to one other and rotating integrally with the main wings; and one or more air entry blockers disposed at a clearance space between the rim and the portion of the casing defining the outlet.

The one or more air entry blockers may be formed on at least one of the rim and the casing portion.

The rim may include a front edge, a rear edge, an inner surface and an outer surface, wherein the front edge is closer to the outlet than the rear edge, and wherein the one or more air entry blockers include a plurality of auxiliary wings formed on the outer surface of the rim. The plurality of auxiliary wings may be disposed in the clearance space.

Each auxiliary wing may have a leading edge at which air flow begins and a trailing edge opposite the leading edge. The leading edge may be positioned further forward towards the direction of rotation than the trailing edge, and the trailing edge may be positioned further forward towards the front of the rim than the leading edge.

An outer radius of the front of the rim may be less than an outer radius of the back of the rim, and a distance between the leading edge of the auxiliary wing and the axis of the axial flow fan may be greater than a distance between the trailing edge of the auxiliary wing and the axis of the axial flow fan. The outer radius of the back of the rim may be greater than a distance between the axis of the axial flow fan and all portions of the auxiliary wings.

The one or more air entry blockers may include a labyrinth seal formed between the rim and the casing portion.

The labyrinth seal may include a corrugation on at least one of the rim and the casing portion.

The one or more air entry blockers may include one or more baffles formed on at least one of the rim and the casing portion.

The one or more baffles may include: a plurality of first baffles on the casing portion and extending around the outlet; and a second baffle on and extending around the rim, wherein the second baffle is disposed between adjacent first baffles. The first baffles may extend from the outlet a greater distance than the second baffle extends from the rim.

The outdoor unit may further comprise a grill over the outlet for preventing foreign objects entering the outlet.

Each main wing may have a leading edge at which airflow begins, a trailing edge opposite the leading edge, and a wing tip between the leading edge and the trailing edge, wherein the rim connects a portion of the wing tips of the main wings to one another. A length of the leading edge may be shorter than a combined length of the wing tip and the trailing edge.

In another aspect of the present invention, an outdoor unit of an air conditioner may include: a casing, including a portion defining an outlet through which air is discharged from the outdoor unit; an axial flow fan disposed within the casing for blowing air through the outlet, wherein the axial flow fan comprises: a hub for connecting to a driveshaft providing rotational force; a plurality of main wings extending radially from the hub; a rim disposed circumferentially around the main wings and connecting the main wings to one other, wherein the rim rotates integrally with the main wings; and a plurality of auxiliary wings disposed on a periphery of the rim for reducing a backflow of outside air through a clearance space between the rim and the portion of the casing defining the outlet.

The portion of the casing defining the outlet may be formed separately from and then fastened to the front surface of the casing, or may be formed integrally with the front surface of the casing.

In yet another aspect of the present invention, an outdoor unit of an air conditioner may include: a casing, including a portion defining an outlet through which air is discharged from the outdoor unit; an axial flow fan for blowing air through the outlet, wherein the axial flow fan comprises: a hub; a plurality of main wings extending from the hub; and a rim connecting the main wings to one other and rotating integrally with the main wings; and means for reducing a backflow of outside air through a clearance space between the rotating rim and the portion of the casing defining the outlet.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to embodiments of the present invention, examples of which is illustrated in the accompanying drawings. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. Wherever possible, the same reference numbers will be used throughout the drawings to refer to the same or like parts.

Figure 1:
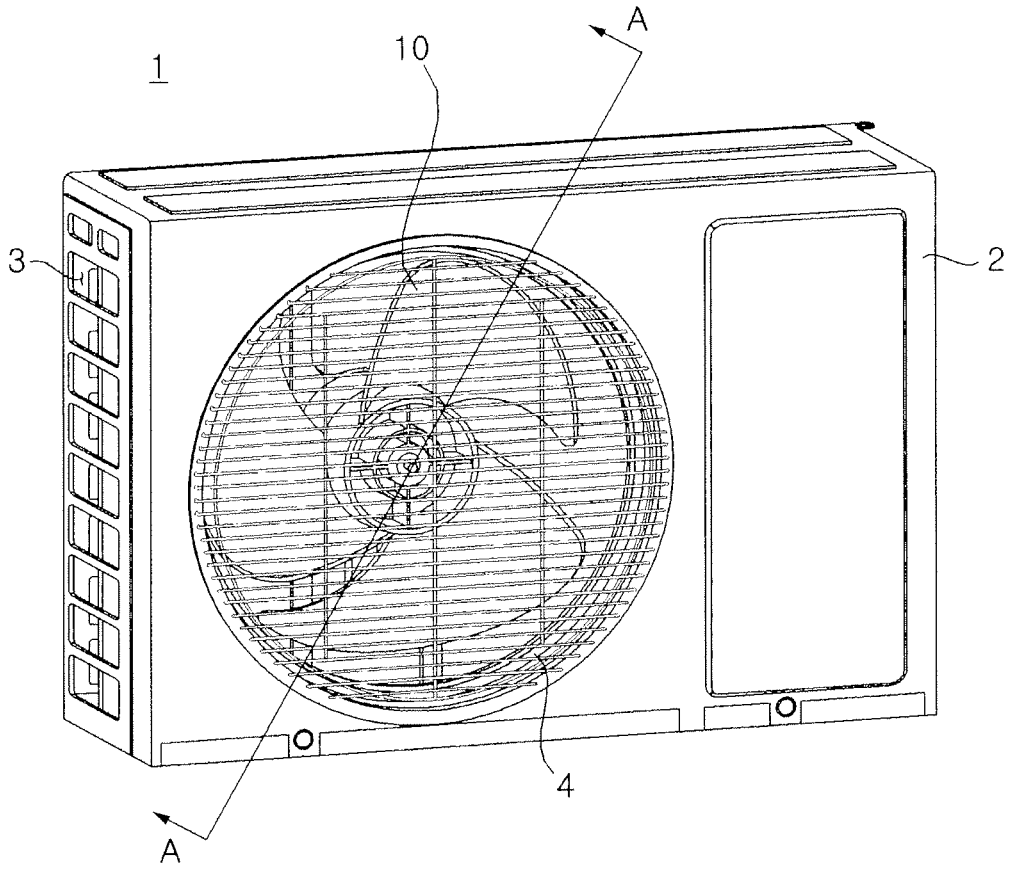
FIG. 1 is a perspective view of an outdoor unit of an air conditioner, including an axial flow fan.
Figure 2:
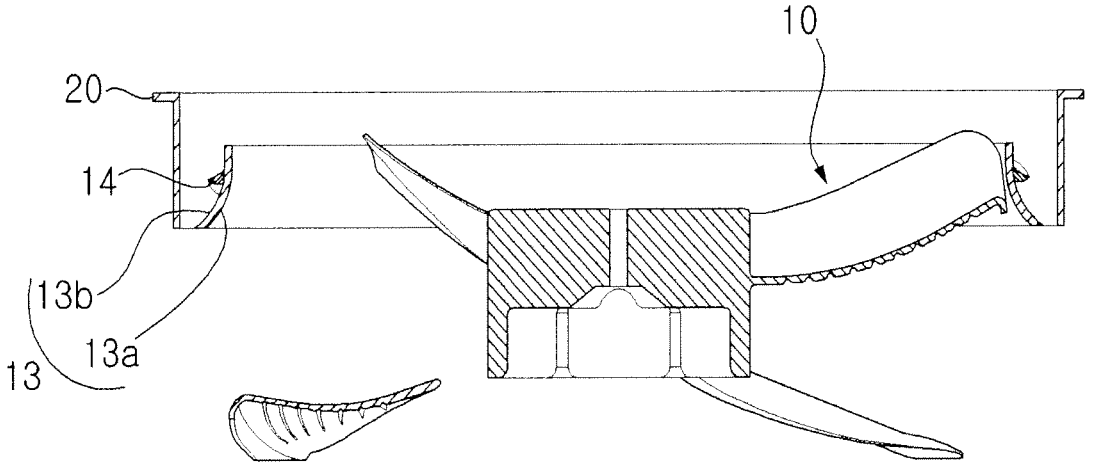
FIG. 2 is a sectional view of FIG. 1 taken along line A-A.
Figure 3:
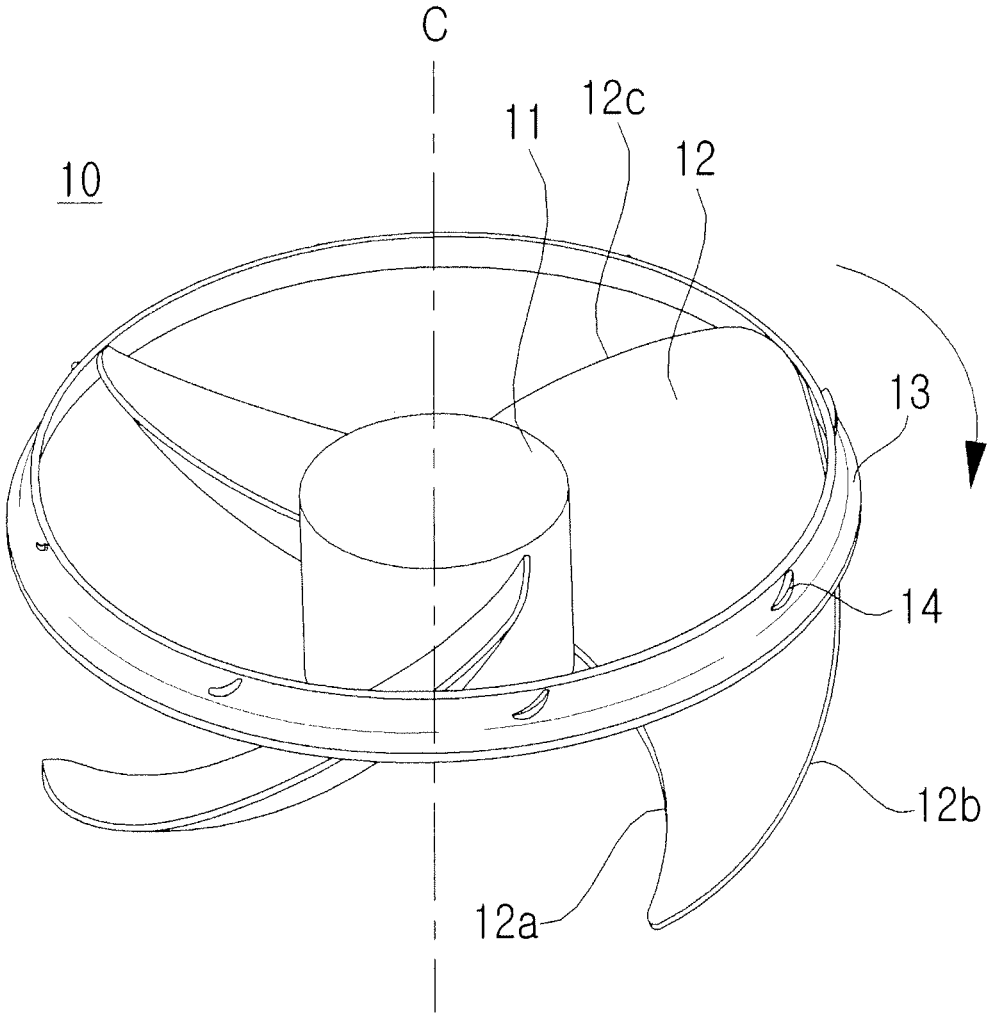
FIG. 3 is a perspective view of the axial flow fan illustrated in FIG. 2.
Figure 4:
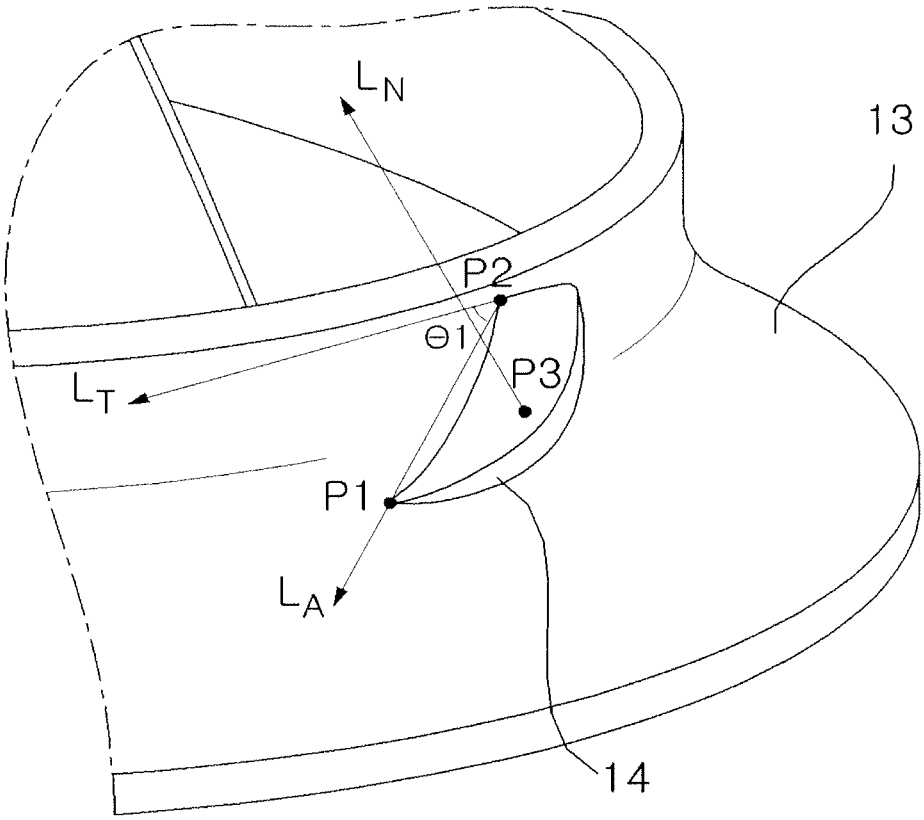
FIG. 4 is an enlarged perspective view of a portion B in FIG. 3.
Figure 5A:
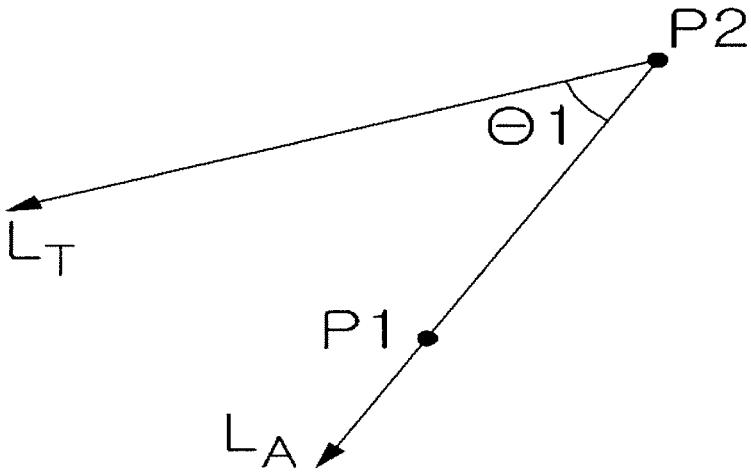
FIGS. 5A and 5B illustrate vectors in FIG. 4.
Figure 5B:
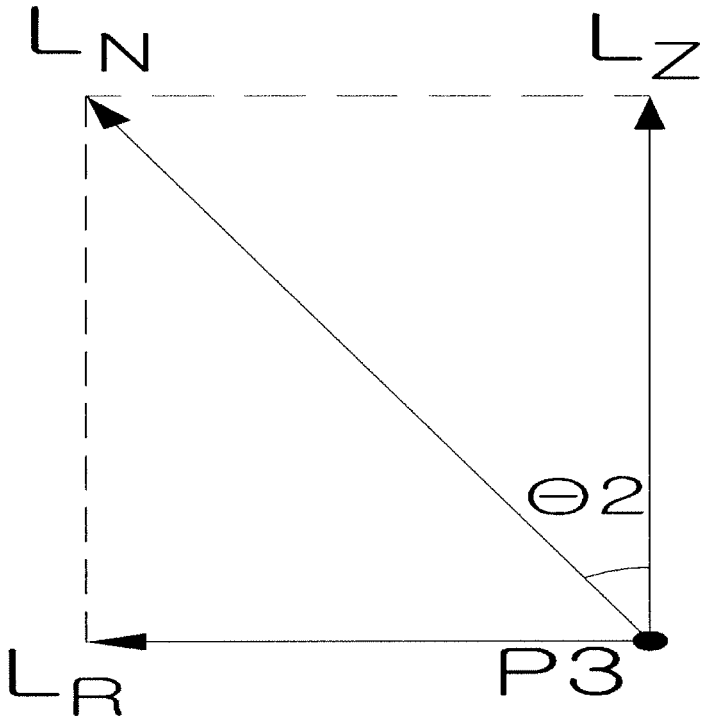

FIG. 1 is a perspective view of an outdoor unit of an outdoor unit of an air conditioner, including an axial flow fan. FIG. 2 is a sectional view of FIG. 1 taken along line A-A, and FIG. 3 is a perspective view of the axial flow fan illustrated in FIG. 2. FIG. 4 is an enlarged perspective view of a portion B in FIG. 3. FIGS. 5A and 5B illustrate vectors in FIG. 4.

Referring to FIGS. 1 and 2, the outdoor unit 1 of an air conditioner may include a casing 2 that defines an exterior of an outdoor unit 1 of an air conditioner, and a motor (not shown) that provides rotational force and an axial flow fan 10 rotated by the motor may be provided within the casing 2.

An inlet 3 may be defined at a side surface of the casing 2, and an opening may be defined at the front surface of the casing 2. A portion 20 of the casing 2 defines an outlet for discharging air blown by the axial fan 10. The casing portion 20 may be a portion 20 that is separately formed and then fastened to the opening defined at the front surface of the casing 2, or the casing portion 10 defining the outlet may be integrally formed with the front surface of the casing 2.

The air blown by the axial flow fan 10 may be discharged to the outdoors through the outlet restricted by the casing portion 20. The casing portion 20 may be provided with a grill 4 for preventing the influx of foreign objects through the outlet.

Referring to FIG. 3, the axial flow fan 10 may be rotated by a driving member such as a motor (not shown), and for this end, may comprise a hub 11 for connecting to a driveshaft of the motor, a plurality of main wings 12 extending radially from the hub 11, and a rim 13 connecting each tip of the main wings 12 to one another and rotating integrally with the main wings 12. The main wings 12 extend radially from the periphery of the hub 11, and have a leading edge 12*a* at which airflow begins to rise, a trailing edge 12*c* at the opposite side of the leading edge 12*a* and a wing tip 12 between the leading edge 12*a* and the trailing edge 12*c*.

Below, the loss of airflow at the tips of the axial flow fan 10 will be referred to as tip leakage loss. Representative causes of tip leakage loss include a vortex generated at the wing tips 12*b* of the main wings 12, and leakage flow that flows in from the outside between the wing tips 12*b* of the main wings 12 and the inner periphery of the casing portion 20. To reduce this tip leakage loss, an axial flow fan 10 connects the wing tips 12*b* of each main wing 12 with a rim 13, to maintain the radial internal clearance between the rim 13 and the casing portion 20 uniformly.

The inner diameter of the rim 13 progressively diminishes according to the flow path of air forced by the main wings 12. Therefore, the rim 13 performs the function of guiding the air moved by the main wings 12 to the outlet, and is formed so that the diameter of the inner periphery 13*a* contacting air moved by the main wings 12 becomes progressively smaller towards the outlet. Likewise, the outer periphery 13*b* of the rim 13 may include a curved surface portion with a diameter that progressively lessens toward the outlet.

By means of the rotation of the axial flow fan 10, most of the air from within the outdoor unit 1 is discharged outward (that is, outdoors), and the effect of the vortex generated between the rim 13 and the casing portion 20—that is, as a result of frictional effects of air between each surface of the rim 13 and casing portion 20—a portion of air has a tendency to flow in the direction opposite to the discharged direction, between the rim 13 and casing portion 20 from the outdoors back into the outdoor unit 1. Below, the flow of air that enters between the rim 13 and casing portion 20 will be defined as leakage flow, as it is a factor that reduces the airflow blown by the axial flow fan 10. The greater the leakage flow, the less the blower performance of the axial flow fan 10 is, and in addition to reducing airflow, leakage flow increases noise.

In order to prevent the occurrence of such leakage flow, the axial flow fan 10 further comprises one or more air entry blockers disposed at a clearance space between the rim and the portion of the casing defining the outlet or any means for reducing a backflow of outside air through a clearance space between the rotating rim and the portion of the casing defining the outlet. Below, descriptions of various embodiments will be provided, and a plurality of auxiliary wings 14 formed along the outer periphery of the rim 13 as illustrated in FIGS. 2 to 5 of the first embodiment will be described first.

When the axial flow fan 10 rotates, forcibly blown air by the main wings 12 is discharged in the axial direction, and here, the auxiliary wings 14 rotate integrally with the rim 13 about the rotational axis (C), and a flow of air formed by the auxiliary wings 14 blocks an influx of air from the outside between the rim 13 and casing portion 20. Accordingly, the flow direction of air forcibly blown by the auxiliary wings 14 may have axial direction components.

Like the main wings 12, the auxiliary wings 14 may be configured as wings extending forward in the direction of rotation. P1 and P2 illustrated in FIGS. 4 and 5A are points indicated on a positive pressure surface of an auxiliary wing 14 on which a pressure greater than atmospheric pressure is applied when the axial flow fan 14 rotates. P1 is the outer end point of the auxiliary wing 14, and P2 is the inner end point of the auxiliary wing, so that P1 is positioned further forward in terms of the direction of rotation than P2. Therefore, an angle $\theta_1$ formed by a line $L_A$ connecting P1 and P2 and a tangent $L_T$ passing P2 and tangential to the outer periphery of the rim 13 is an acute angle.

Referring to FIGS. 4 and 5B, a certain normal line $L_N$ perpendicular to the positive pressure surface of the auxiliary wing 14 may be represented as the sum of a component $L_z$ parallel to the rotational axis (C) and a directional component $L_R$ toward the central portion of the rim 13, and an angle $\theta_2$ formed by $L_N$ and $L_Z$ has a value of less than 90 degrees. Accordingly, air blown by the positive pressure surfaces of the auxiliary wings 14 generates an air curtain between the rim 13 and casing portion 20 to block entry of air from the outside.

Particularly, when $\theta_2$ is an acute angle, because airflow is discharged by the auxiliary wings 14 between the rim 13 and casing portion 20 to the outside, it adds to the airflow discharged by the main wings 11 to increase total airflow.

Figure 6:
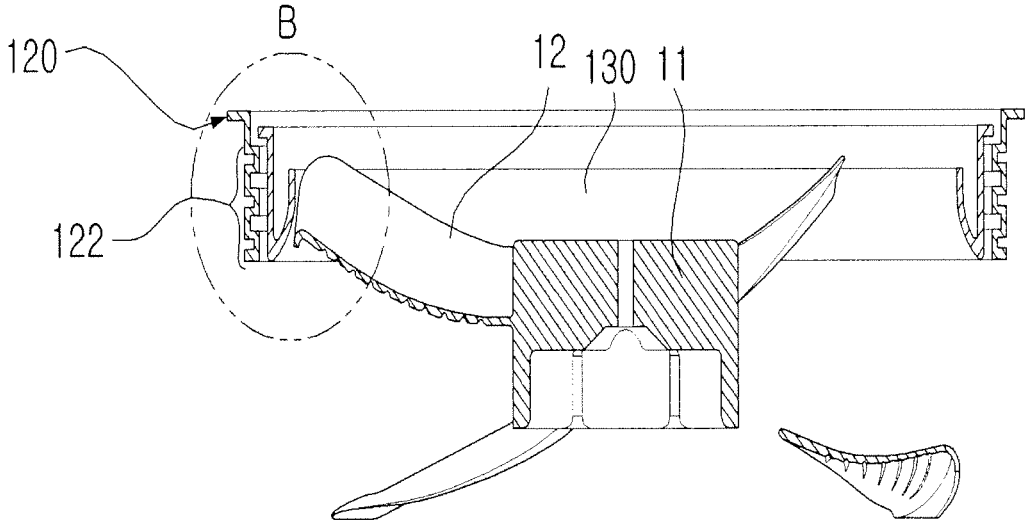
FIG. 6 illustrates another an outdoor unit of an air conditioner, including an axial flow fan.
Figure 7:
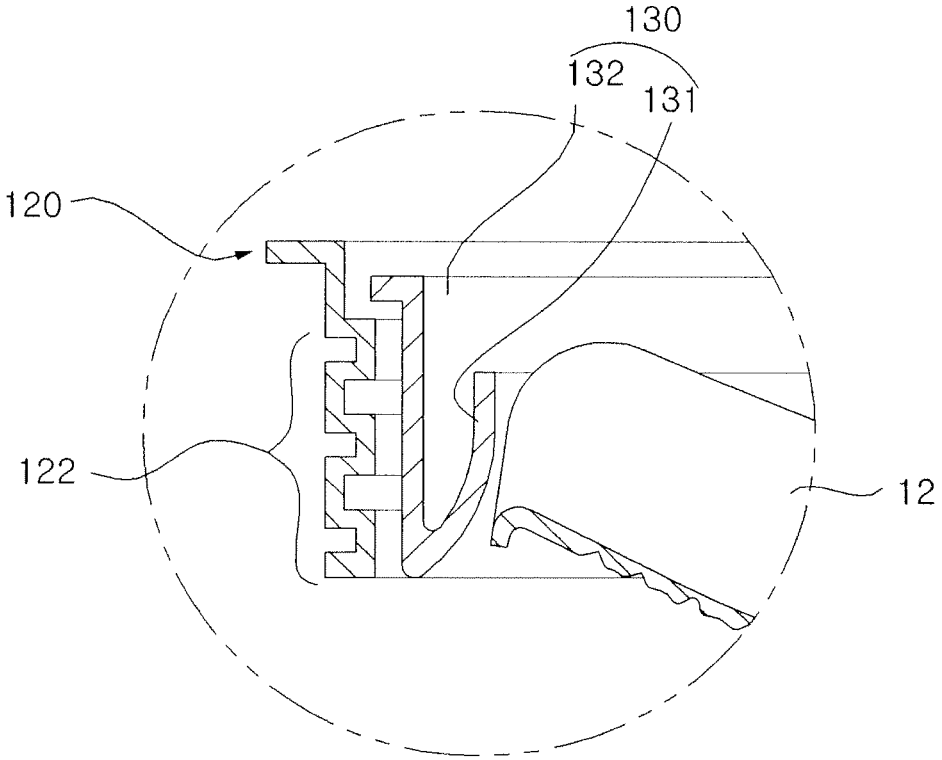
FIG. 7 is an enlarged view of portion B in FIG. 6.

FIG. 6 illustrates a second embodiment. FIG. 7 is an enlarged view of portion B in FIG. 6. Referring to FIGS. 6 and 7, a labyrinth seal is disposed between a casing portion 120 and a rim 130.

To form a labyrinth seal, corrugations 122 may be formed in at least one of the inner periphery of the casing portion and the outer periphery of the rim 130. While FIG. 6 depicts corrugations formed in the inner periphery of the casing portion 120, corrugations may alternately be formed on the outer periphery of the rim 130, or corrugations may be formed respectively on the inner periphery of the casing portion 120 and the outer periphery of the rim 130 to form labyrinth.

The rim 130 connects the wing tips 12*b* of the main wings 12 to one another and comprises a curved portion 131 with an inner diameter that progressively decreases in the flow direction of air forcibly blown by the main wings 12, and a side surface portion 132 extending from the curved portion 131 parallel to the casing portion 120. While the labyrinth seal in FIG. 7 is configured of a labyrinth formed between corrugations 122 defined in the inner periphery of the casing portion 120 and the side surface portion 132 of the rim 130, corrugations may also be defined in the side surface portion 132 of the rim 130 to make the labyrinth even narrower.

Figure 8:
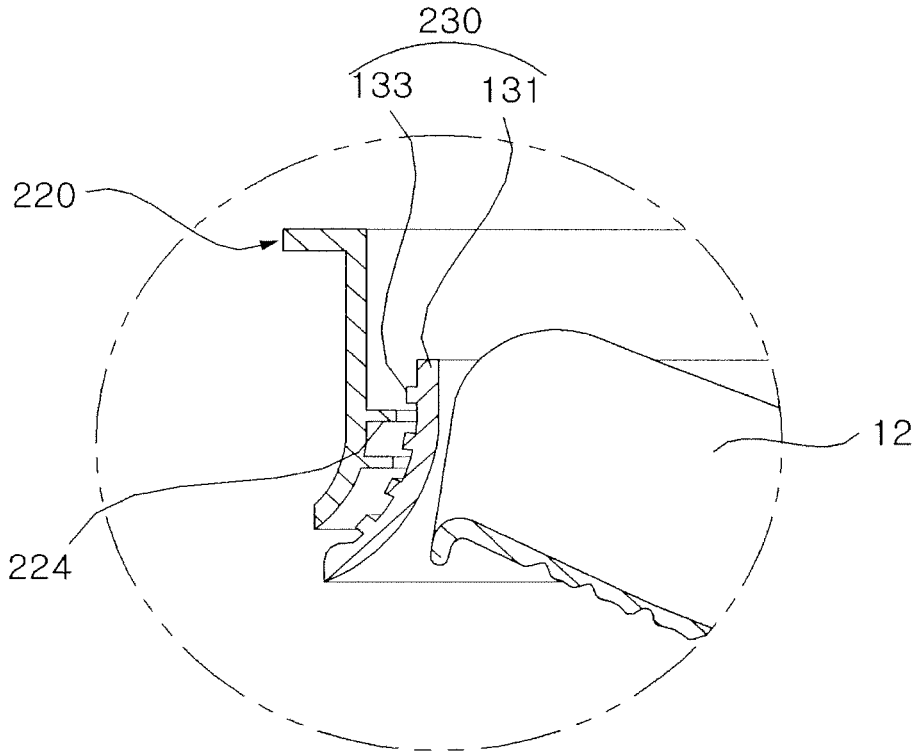
FIG. 8 is an enlarged view of a portion of another outdoor unit of an air conditioner.

FIG. 8 illustrates another embodiment. Referring to FIG. 8, a baffle is formed on at least one of the inner periphery of a casing portion 220 and the outer periphery of a rim 230. The baffle denotes a device that restricts the flow of fluid in a certain path or redirects flow, and in this embodiment, a first baffle 224 may be formed extending in annular form along the inner periphery of the casing portion 220, and a second baffle 133 may be formed extending in annular form along the outer periphery of the curved portion 131 of the rim 230, in order to block air flowing thorough the radial internal clearance between the casing portion 220 and the rim 230.

Here, the first baffle 224 and the second baffle 133 are respectively formed in plurality, with the second baffles 133 disposed between the first baffles 224. Also, in order to reduce noise generated when the rim 230 rotates at high speed, the second baffle 133 may be formed at a lower height than the first baffle 224.

The outdoor unit of an air conditioner according to embodiments of the present invention block the influx of air between blade tips of an axial flow fan and outlet, so that the airflow blown by the axial flow fan may be increased. Also, the outdoor unit may reduce noise generated during rotation of the axial flow fan.

Also, the outdoor unit of an air conditioner may prevent inflow of outside air through a radial clearance between a rotating axial flow fan and a casing portion defining an outlet.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An outdoor unit of an air conditioner, comprising:

a casing, including a portion defining an outlet through which air is discharged from the outdoor unit;

an axial flow fan disposed in the casing for blowing air through the outlet, wherein the axial flow fan comprises:

a hub;

a plurality of main wings extending from the hub;

a rim connecting the main wings to one other and rotating integrally with the main wings; and a plurality of auxiliary wings disposed at a clearance space between the rim and the portion of the casing defining the outlet, wherein each auxiliary wing has a leading edge at which air flow begins and a trailing edge opposite the leading edge, wherein the leading edge is positioned further forward towards the direction of rotation than the trailing edge, wherein the trailing edge is positioned further forward towards the front of the rim than the leading edge, wherein an outer radius of the front of the rim is less than an outer radius of the back of the rim, and wherein a point at which the trailing edge meets the rim is closer to the front of the rim than a farthest point on the auxiliary wing from the axis of the axial flow fan.

2. The outdoor unit of claim 1, wherein the outer radius of the back of the rim is greater than a distance between the axis of the axial flow fan and all portions of the auxiliary wings.

3. The outdoor unit of claim 1, further comprising a grill over the outlet for preventing foreign objects entering the outlet.

4. The outdoor unit of claim 1, wherein each main wing has a leading edge at which airflow begins, a trailing edge opposite the leading edge, and a wing tip between the leading edge and the trailing edge, wherein the rim connects a portion of the wing tips of the main wings to one another.

5. The outdoor unit of claim 4, wherein a length of the leading edge of the main wing is shorter than a combined length of the wing tip and the trailing edge of the main wing.

6. The outdoor unit of claim 1, wherein the portion of the casing defining the outlet is formed separately from and then fastened to the front surface of the casing.

7. The outdoor unit of claim 1, wherein the portion of the casing defining the outlet is formed integrally with the front surface of the casing.

* * * * *